United States Patent [19]

Martini

[11] 3,961,756

[45] June 8, 1976

[54] ADJUSTABLE-SPRAY MECHANISM

[75] Inventor: Leo A. Martini, Mesquite, Tex.

[73] Assignee: National Chemsearch Corporation, Irving, Tex.

[22] Filed: Feb. 10, 1975

[21] Appl. No.: 548,515

[52] U.S. Cl. ..... 239/337; 239/373; 239/463; 239/485; 239/493; 239/582; 239/583; 222/402.1

[51] Int. Cl.[2] ..... B05B 7/32; B05B 1/30; B05B 1/34

[58] Field of Search ..... 239/337, 354, 373, 401, 239/463, 476, 482–485, 490, 493, 579, 581, 582, 583; 222/402.1, 402.11, 552

[56] References Cited

UNITED STATES PATENTS

| | | | |
|---|---|---|---|
| 1,461,545 | 7/1923 | Purnell | 239/493 X |
| 1,940,171 | 12/1933 | Huss | 239/493 |
| 2,044,694 | 6/1936 | Huss | 239/493 |
| 2,090,334 | 8/1937 | Paasche | 239/337 |
| 2,321,428 | 6/1943 | Schloz | 239/493 X |
| 3,061,203 | 10/1962 | Kitabayashi | 239/424 X |
| 3,100,084 | 8/1963 | Biber | 239/493 X |
| 3,112,074 | 11/1963 | Green | 239/463 X |
| 3,580,431 | 5/1971 | Kuffer et al. | 222/402.1 |
| 3,593,926 | 7/1971 | Kozub | 239/582 X |
| 3,648,932 | 3/1972 | Ewald et al. | 239/337 |

FOREIGN PATENTS OR APPLICATIONS

| | | | |
|---|---|---|---|
| 176,304 | 9/1922 | United Kingdom | 239/485 |
| 533,621 | 2/1941 | United Kingdom | 239/485 |

*Primary Examiner*—Robert S. Ward, Jr.
*Attorney, Agent, or Firm*—Bernard A. Reiter

[57] ABSTRACT

An improved adjustable-spray mechanism which includes a button body to be fixedly connected to the exit stem of an aerosol or other fluid container, the button body being characterized by a bore having an end wall. An orifice extends through the end wall from the bore and constitutes a spray outlet to the environment. An adjustable valve is disposed in the bore so as to selectively advance toward or retract from the end wall. Upon introduction of fluid to the bore, a variable fluid spray pattern can be obtained upon adjustment of the valve toward or away from the orifice in the wall.

4 Claims, 4 Drawing Figures

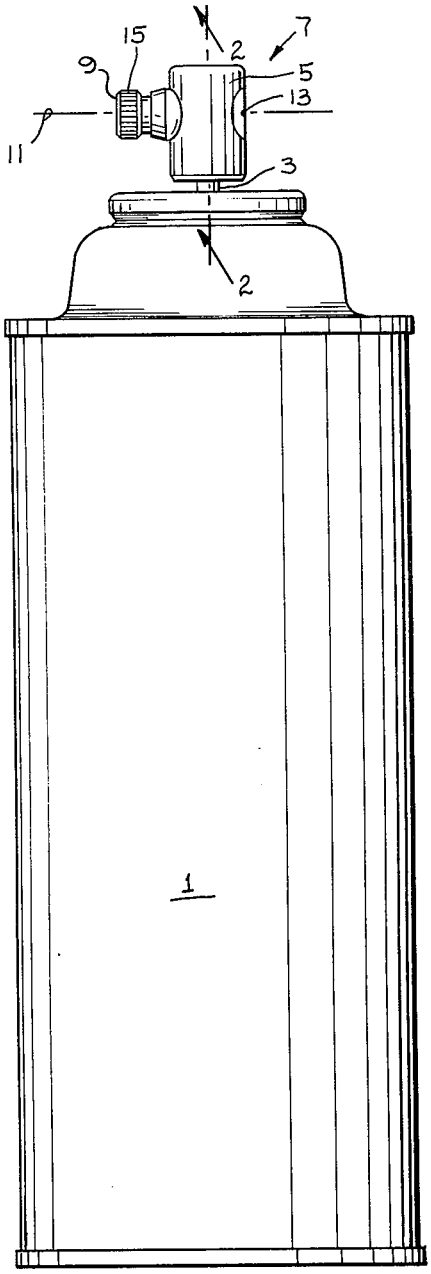
fig.1
fig.2
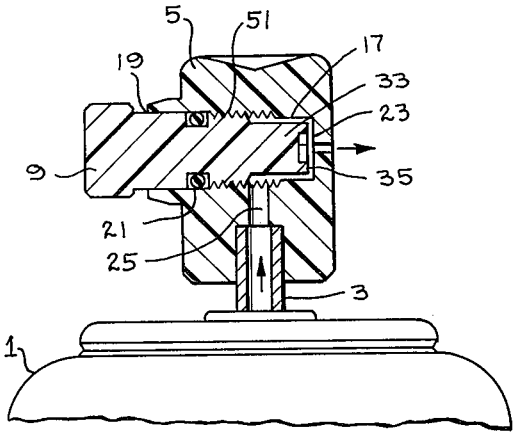
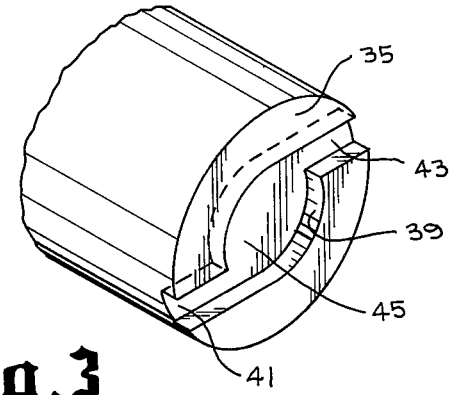
fig.3
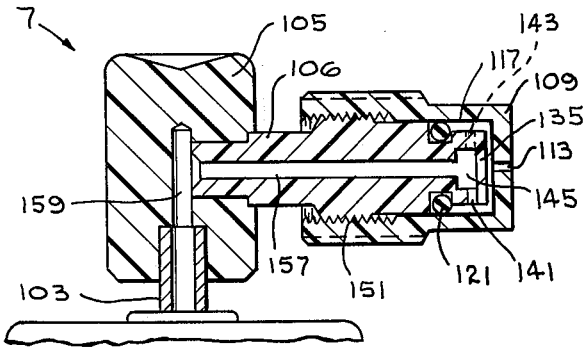
fig.4

ADJUSTABLE-SPRAY MECHANISM

BACKGROUND OF THE INVENTION

The present invention generally relates to adjustable-spray mechanisms. More particularly, the invention relates to a valving mechanism for use with aerosol or other spray containers so as to vary the pattern and pressure of the fluid emitted.

The utilization of valving mechanisms on aerosol and other fluid spray containers for varying the pattern and pressure of the fluid is old and well known. Generally, however, these devices have heretofore been relatively complex, expensive to manufacture and prone to clogging, binding and similar mechanical deficiency that would develop prior to the depletion of fluid from the container. This, in turn, produces waste of the fluid and adversely effects future sales of the same product. It has been common therefore for manufacturers of fluid containers to avoid utilization of spray adjustment mechanisms even though such devices may accomplish a distinct and advantageous objective.

SUMMARY OF THE INVENTION

The present invention endeavors to obviate the mechanical and functional disadvantages which have characterized spray adjustment devices heretofore. Specifically, the present invention provides a spray adjustment device that comprises a single moving part and which is therefore remarkably easy to operate and inexpensive to manufacture. Moreover, the opportunity for operational malfunction is substantially eliminated because clogging and the like is effectively precluded due to the presence of a valve component that may be readily removed in order to clear away obstructions. Mechanical malfunction is likewise substantially eliminated because the single moving part, that is the valve component, is itself a unitary body. These and numerous other features and advantages of the invention will become more readily apparent upon a reading of the following detailed disclosure, claims and drawings, wherein like numerals denote like parts in the several views and wherein:

DETAILED DESCRIPTION OF THE DRAWINGS

FIG. 1 is a side view of an aerosol container having an adjustable-spray mechanism of the type disclosed herein affixed to the stem thereof.

FIG. 2 is a cross sectional view of the adjustable-spray mechanism of FIG. 1 along the plane 2—2 thereof.

FIG. 3 is an enlarged isometric view of an exemplary form of the valve face means.

FIG. 4 is an alternative embodiment of the adjustable-spray mechanism of the invention.

DETAILED DESCRIPTION OF THE DRAWINGS

With reference now to FIG. 1 there is shown a conventional aerosol or other fluid container. Extending from the top of the container is an outlet stem 3 through which the fluid exits the container. Affixed to the upper end of the stem, generally by frictional engagement, is a button body or first body means 5 of the adjustable-spray mechanism, generally designated as 7 of the invention. Transversely disposed with respect to the button body 5 and disposed in a recess therein is the valve body or second body means 9. The valve body is constructed to advance or retract along its own longitudinal axis 11 so as to approach or withdraw from the outlet orifice 13 in valve body 9. Movement of the valve body 9 may be facilitated by knurls which are placed on the finger gripping portion 15 of the body 9.

As best shown in FIG. 2, the button body 5 is characterized by a bore or recess means 17 for receiving the valve body 9. The bore or recess means 17 is sized to fittingly receive the valve body at the entry end 19 of the recess. An appropriate seal 21, such as an O-ring, quad ring, packing or the like is provided to insulate against fluid leakage. At the exit end of recess means 17 it is seen that the outlet orifice 13 may be generally aligned with the longitudinal axis 11 of the valve body. The recess means 17 itself includes an end wall means 23 generally surrounding the outlet orifice 13. An inlet orifice 25 communicates with the stem 3 so as to provide for entry of fluid from container 1 into the recess means 17 when the button body is moved, so as to actuate the aerosol system.

The valve body 9 is characterized by an operative end 33 of reduced dimension and which is adapted to reside within the recess means 17, but which may rest at varying distances with respect to end wall means 23. The operative end 33 of body 9 includes a nose surface 35 that generally opposes the end wall means 23. As best shown in FIG. 3, the nose surface 35 includes a turbulence shelf 39 or other means for producing a swirling path of fluid flow substantially about the axis of outlet orifice 13 an in opposing adjacent relation thereto. Fluid conduit means 41 and 43 serve to permit entry of fluid into the turbulence shelf 39 so as to effectively produce the vortex like stream about the outlet orifice. It will be recognized that various geometric configurations may be provided on the nose surface 35 for accomplishing a swirling path of fluid flow. This swirling or spinning effect of the fluid may, for example, be produced by holes of various shapes extending from the circumference or external surface of the valve body 9 inwardly to the turbulence shelf area. Such holes or bores, as they may be, may, like that of FIG. 3, be placed approximately tangentially to the axis 11 of the valve body so as to direct fluid to the counter bore means 45 which is recessed from the nose surface means 35. The counter bore means 45 cooperates with end wall means 23 to impart to the fluid path a vortex flow generally about the outlet orifice 13.

With further reference to FIG. 2, the valve body 9 is shown to be longitudinally movable in either a forward or rearward direction with respect to the orifice 13. This is accomplished, as shown for exemplary purposes by this view, through the utilization of cooperating threads 51 externally disposed on the surface of the valve body 9 and internally disposed on the recess means 17. Any adjustment means other than threads 51, such as a movable or the like diaphragm, may be provided for the purpose of advancing or retracting the nose surfaces with respect to the end wall means.

In an alternative form of the invention, there is shown in FIG. 4 a substantial reversal of the movable-fixed components shown in FIG. 2. Here (FIG. 4) it is seen that the button body 105 is affixed to the stem 103 through a frictional engagement in much the same manner as shown in FIG. 1. Extending from the button body 105 and fixedly connected thereto, as in integral fashion, is the button body arm 106 having a plurality of external threads 151 provided thereon. Threadably engaging the exterior of arm 106 is a valve body 109 and which is characterized by a recess means 117 extending thereinto. The button body arm 106 includes fluid conduit means 157 which, at one end, leads to a counter bore means 145 in the nose surface similar to that illustrated in FIG. 3. The other end of the fluid conduit 157 communicates with the conduit 159 of the button body 105. An appropriate seal 121 is again provided to insulate against leakage of the fluid from the recess means 117 formed by the button body arm 106 and valve body 109.

In operation of the devices of FIGS. 2, 4, respectively, it will be visualized that fluid flow from the container is actuated by appropriate depression or movement of the button body 5, 105 of the adjustable-spray device 7. In so doing, fluid is caused to flow through the stem 3, 103 and into the recess means 17, 117. Such recess means, whether it be in button body 5 (FIG. 2) or in valve body 109 (FIG. 4), is quickly filled with fluid. The fluid immediately passes from the recess means through the conduit means 41, 43 (of FIG. 3) and 141, 143 (of FIG. 4) and into the nose counter bore means 45, 145. It is thus recognized, in the device of FIG. 4, that the adjustable spray structure is integral with the arm 106 of button body 105 while, in the design of FIG. 2, it is integral with the valve body 109.

With respect to the embodiment of FIG. 3 it may be visualized that the turbulence shelf or swirl means 39 produces a vortex or fluid swirling action adjacent to the outlet orifice 13 of the button body 5. Since the valve body 9 may be moved along it's longitudinal axis, it may be visualized that a variable area of fluid flow exists between the end wall means 23 and the nose of the valve body. Such variable area of fluid flow, when combined with the swirling condition of the fluid produced by the configuration of the valve nose, provides a structure for effectively varying the spray pattern and pressure level of fluid emitted from orifice 13. More particularly, the swirling condition of the flow produces a centrifugal force on the fluid, this markedly increasing its velocity. The swirling condition is also characterized by an outwardly directed spin component which, in conjunction with the forward force component of fluid pressure produced by the ambient pressure of the fluid, serves to create a cone shaped spray pattern. The included angle of the cone spray is thus a function of the two components, spin velocity and forward velocity of the exiting fluid. The relative position of the nose means 35 to the end wall means 23 will influence the degree of swirl or vortex-like flow, and therefore the cone spray angle.

By way of example, it may be visualized, with respect to FIGS. 1–3, that upon retraction of the valve body 9 toward the orifice 13 of end wall means 23, there results an increasingly diffused and dispersed spray pattern; while advancement of the valve body to a position remote from the orifice 13 of end wall means 23 results in emission of the fluid in a most concentrated and linear pattern. Conversely, but similarly, the structure of FIG. 4 produces either a dispersed or concentrated pattern of fluid emission from the outlet orifice 113. Here, rather than moving the valve body within the button body in order to vary the volume of the recess means, the valve body 109 is moved exteriorly of the button body arm 106 in order to vary the volume of the recess means 117, and thus alter the distance between the cooperating walls.

It is believed apparent that other modifications than those shown in FIG. 4 will clearly fall within the scope of the present invention, as it may be defined in the claims following hereafter. For example, it shall be within the province of the present invention to dispose the counter bore means 45 and the turbulence shelf 39, or other such swirl means, in the end wall means 23 rather than in the nose surface 35 as has herein been explained. The same modification may be made to the structure of either of FIGS. 3 or 4. Likewise, other such fluid conduit means than those shown at 41, 43, or other such swirl means 39 may be used than those shown. All such obvious modifications, rearrangements and like mechanical equivalents are considered and deemed to lie within the scope of the disclosure set forth hereinabove and within the spirit of the claims appended hereto.

Therefore, that which is claimed and desired to be secured by United States Letters Patent is:

1. An improved adjustable spray tip for selectively varying the spray pattern from a wide angle misting spray to a concentrated stream, comprising, bore button body having a bore therein for receiving an adjustable valve means, the internal end of the bor defining an end wall, an outlet orifice communicating with the end wall of said bore and extending to the exterior surface of the button body for expelling the spray, an adjustable valve means in said bore, said adjustable valve means including advancement-retraction means operatively associated therewith and with the bore for moving the valve means toward or away from said outlet orifice, said adjustable valve means being of cylindrical configuration and including a nose surface at the end thereof proximate said outlet orifice, fluid swirl means operatively associated with the outlet orifice for imparting a vortex flow to the fluid about the axis of the bore, and, said fluid swirl means including a counterbore means of circular shape in the nose surface of said valve means, the counterbore means being recessed a predetermined depth in the nose surface, fluid conduit means in the nose surface extending inwardly from the surface of the cylindrical valve means into tangential intersection with said circular counterbore means, the depth of said fluid conduit means being the same as said counterbore means, so that the entire volume of fluid introduced to the counterbore means is subjected to maximum centrifugal forces of rotation prior to escape through the outlet orifice, a fluid inlet passage communicating with the bore so that upon introduction of a fluid stream to the bore, the stream is caused to swirl about the end of the valve means adjacent the inlet orifice whereby advancement or retraction of the valve means with respect to the orifice produces a respective correlative stream-like or mist-like spray pattern.

2. An improved adjustable-spray mechanism to be attached to a fluid container for varying the pattern of spray emanating therefrom, comprising:

a first body means having a bore therein, said bore including an internal end wall that defines the bottom of the bore, an outlet orifice communicating with the bore and extending through said internal end wall to the outside and through which fluid flow is transmitted, a second body means disposed in the bore of said first body means, said second body means including an end wall disposed adjacent to the bore end wall, and adjustment means cooperating with said first body means and second body means for producing advancement and retraction of the one body end wall relative to the other body end wall, so that upon introduction of fluid between the walls there is produced a varying angular pattern of fluid expulsion from said outlet orifice, the end wall of said second body means being characterized by a circular recess therein of predetermined depth, and which depth defines a turbulence shelf means for containing a quantity of fluid therein prior to expulsion through said outlet orifice, a plurality of fluid conduit means extending from the surface of said second body means, said fluid conduit means consisting of channels on the end wall of said second body means and which are oriented to intersect said circular recessed tangentially, the channels intersecting the circular recess at the same depth as the turbulence shelf, so as to maximize the volume of fluid subjected to said centrifugal force.

3. An improved adjustable spray mechanism in combination with a fluid container wherein a variable pattern of fluid spray may be selectively emitted from the adjustable-spray nozzle mechanism, the improvement residing in said adjustable spray mechanism comprising:

a first body means having a recess therein, an outlet orifice in said first body means communicating with said recess and with the ambient environment exteriorly of the first body means, a second body means residing within the recess of said first body means and defining a variable volumetric area adjacent to said outlet orifice, adjustment means cooperatively engaging said first body means and said second body means to produce movement of said bodies with respect to one another so as to vary the distance of said second body with respect to the outlet orifice of the first body, and conduit means communicating with the fluid container at one end and the volumetric area adjacent the outlet orifice of the adjustable spray nozzle mechanism at the other end, so as to provide fluids thereto for variable emission from said outlet orifice depending upon the relative position of the second body means with respect to the first body means, and fluid swirl means adjacent said outlet orifice for subjecting the fluid to a vortex flow prior to expulsion from the nozzle mechanism, the fluid swirl means consisting of a cavity defined by a circular wall of predetermined depth and a plurality of conduit means communicating therewith from the surface of said second body, said conduit means intersecting the circular cavity tangentially and at the bottom thereof, so as to introduce continuously the maximum volume of fluid to the vortex created in the cavity.

4. An improved adjustable-spray mechanism to be attached to a fluid container for varying the pattern of spray emanating therefrom and comprising:

a first body means having a bore therein, said bore including an internal end wall that defines the bottom of the bore, an outlet orifice communicating with the bore and extending through said internal end wall to the outside, and through which fluid flow is transmitted, a second body means disposed in the bore of said first body means, said second body means including an end wall disposed adjacent to the bore end wall, and, adjustment means cooperating with said first body means and second body means for producing advancement and retraction of the one body end wall relative to the other body end wall so that upon introduction of fluid between the walls there is produced a varying angular pattern of fluid expulsion from said outlet orifice, said bore and second body means being of substantially rounded cross-section configuration, the end of said second body means adjacent the end wall being of reduced cross-section so as to provide a substantially annular area for fluid flow, conduit means communicating at one end with the end wall and at the other end with a source of fluid and fluid swirl means disposed at the end of said second body means so that the fluid is caused to spin in a turbulent vortex-like flow, said fluid swirl means including a circular-like cavity of predetermined depth having a wall which defines a turbulence shelf, and fluid channels extending into the cavity from the surface of said second body means to intersect the turbulence shelf tangentially and at the same depth as the depth of the cavity so as to thereby permit introduction of a maximum volume of fluid to the vortex producing structure of the fluid swirl means.

* * * * *